US006109430A

United States Patent [19]

Bando et al.

[11] Patent Number: 6,109,430

[45] Date of Patent: Aug. 29, 2000

[54] PRODUCT HOUSING STACKED BODY OF WET TISSUES

[75] Inventors: Takeshi Bando; Yukiko Iida; Yoshikazu Tanaka, all of Kagawa, Japan

[73] Assignee: Uni-Charm Corporation, Kawanoe, Japan

[21] Appl. No.: 09/379,954

[22] Filed: Aug. 24, 1999

[30] Foreign Application Priority Data

Sep. 4, 1998 [JP] Japan ..... 98-250916

[51] Int. Cl.[7] ..... B65D 85/62; A47K 7/02

[52] U.S. Cl. ..... 206/207; 206/494; 206/812; 221/45; 221/48

[58] Field of Search ..... 206/207, 209, 206/210, 494, 499, 812; 221/34, 35, 38, 45, 48–54, 63

[56] References Cited

U.S. PATENT DOCUMENTS

| | | | |
|---|---|---|---|
| 3,679,094 | 7/1972 | Nissen et al. | 221/50 |
| 3,679,095 | 7/1972 | Nissen et al. | 221/50 |
| 3,784,056 | 1/1974 | Spruyt et al. | 221/63 |
| 3,836,044 | 9/1974 | Tilp et al. | 221/55 |
| 3,994,417 | 11/1976 | Boedecker | 221/48 |
| 4,138,034 | 2/1979 | McCarthy | 221/48 |
| 4,181,225 | 1/1980 | Spiegelberg | 206/494 |
| 4,638,921 | 1/1987 | Sigl et al. | 221/48 |
| 4,817,790 | 4/1989 | Porat et al. | 206/210 |
| 5,607,081 | 3/1997 | Levy | 206/494 |
| 5,992,682 | 11/1999 | Loppnow et al. | 221/48 |

*Primary Examiner*—Jim Foster
*Attorney, Agent, or Firm*—Darby & Darby

[57] ABSTRACT

A wet tissue product composed of a stacked body of folded wet tissues and a container or package housing the stacked body in which each of the folded wet tissues is formed by folding a plane wet tissue with opposite edges thereof to the same side along folding line portions to have a first folded portion, a second folded portion and an intermediate portion between the upper and lower folded portions. The folded wet tissues are consecutively combined such that the folding line portion forming the second folded portion of the upper wet tissue is sandwiched between the first folded portion and the intermediate portion of the lower wet tissue, and the second folded portion of the upper wet tissue and the first folded portion of the lower wet tissue are in face-to-face contact with each other.

5 Claims, 11 Drawing Sheets

PRODUCT HOUSING STACKED BODY OF WET TISSUES

FIELD OF THE INVENTION

The present invention relates to a wet tissue product having a stacked body of folded wet tissues housed in a container or package.

BACKGROUND OF THE INVENTION

In general, wet tissues are scaled and housed in a container or package so as to keep their wet state before used or when unused. These wet tissues are stacked, such that they have overlapping portions between the upper and lower wet tissues, so that they are consecutively and sequentially pulled out of an outlet provided in the container or package. When the wet tissue at the uppermost position is pulled out, a portion of the succeeding wet tissue is protruded from the outlet of the container. This is generally called the "pop-up type". The conventional wet tissue stacked body of this "pop-up type" will be described with reference to the drawings.

One example of the conventional wet tissue stacked body, as shown in FIG. 9, is formed in the following manner. First, a wet tissue 61A is folded in two along its center line 64 as a folding line, as shown in FIG. 7(A), such that a wet tissue 61B having such a shape as shown in FIG. 7(B) is provided. In FIG. 9, the wet tissues 61B are stacked such that a lower half 63 of the upper wet tissue 61B is sandwiched between an upper half 62 and a lower half 63 of the lower wet tissue 61B.

When the upper wet tissue 61B is pulled out, the upper half 62 of the lower wet tissue 61B, which is put on the lower half 63 of the upper wet tissue 61B, is pulled up together toward the outlet (not shown) to be pulled out from the outlet. Thus, the upper half 62 of the lower wet tissue 61B comes out of the outlet so that the wet tissues can be pulled out consecutively one by one.

However, in the wet tissue stacked body shown in FIG. 9, the overlapping area between the lower half 63 of the upper wet tissue 61B and the upper half 62 of the lower wet tissue 61B is as large as about one half of the area of the wet tissue 61A before being folded. Therefore, when the upper wet tissue 61B is pulled out, the length of the protrusion of the succeeding lower wet tissue 61B becomes as large as about one half of the length of the wet tissue 61A before being folded.

If the protrusion of the wet tissue is too large, it can not be confined within the area of a cover which is usually provided with the container or package to cover the outlet As a result, the protrusion partially extends out of the cover. Then, the wet tissue dries up at this portion extending out of the cover. Moreover, when the protrusion partially extends out of the cover, it is difficult to close the cover reliably. This lowers the sealability of the container or package, so that the overall wet tissue stacked body is liable to dry up.

FIG. 10 shows another example of the conventional wet tissue stacked body. The wet tissue stacked body shown in FIG. 10 is formed in the following manner. A wet tissue 71A, as shown in FIG. 8(A), is folded back at its end portions toward the opposite faces along the folding lines 75 and 76 which divide the wet tissue 71A substantially in three, such that a wet tissue 71B having such a shape as shown in FIG. 8(B) is formed. As shown in FIG. 10, the wet tissues 71B are stacked such that a lower portion 72 of the upper wet tissue 71B is sandwiched between an upper portion 74 and an intermediate portion 73 of the succeeding lower wet tissue 71B.

In this construction, the overlapping area between the lower portion 72 of the upper wet tissue 71B and the upper portion 74 of the lower wet tissue 71B is as large as about one third of the area of the wet tissue 71A before folded. Therefore, the length of the protrusion of the succeeding lower wet tissue 71B becomes shorter than that of the example shown in FIG. 9. However, since the wet tissue 71B is folded in three, the stacked body composed of a plurality of wet tissues 71B becomes too thick.

Disclosed in Japanese Patent Laid-Open No. 213453/1995(which corresponding U.S. Pat. No. 5,497,903) is a wet tissue folding structure which allows the wet tissues to be consecutively pulled out. This wet tissue folding structure is shown in FIG. 11. In this folding structure, the lower half 63 of the wet tissue 61B shown in FIG. 7(B) is further folded in two along a folding line 65 to form a wet tissue 61C shown in FIG. 7(C). As shown in FIG. 11, the wet tissues 61C are then stacked such that the upper half 62 of the lower wet tissue 61C is sandwiched between the upper half 62 and an intermediate portion 66 of the upper wet tissue 61C.

Here, as shown in FIG. 11, the wet tissue 61C is further indicated by 61C1, 61C2 and 61C3, in order from the top. When the wet tissue 61C1 is pulled out, the righthand half of the upper half 62 of the wet tissue 61C2 is pulled up together with the intermediate portion 66, of the wet tissue 61C1 and protruded from the outlet. In this folding structure, therefore, the length of the protrusion of the succeeding lower wet tissue 61C is optimized to about one quarter of the length of the wet tissue 61A before being folded. Moreover, the stacked body does not become too thick.

However, the folded wet tissue 61C composing the wet tissue stacked body shown in FIG. 11 is formed by folding the wet tissue 61A along the widthwise center line 64 and then by folding only the lower half 63 along the folding line 65. As a result, the widthwise center line of the folded wet tissue 61C is not identical to that of the unfolded wet tissue 61A. Therefore, the wet tissue has to be supplied to the folding step while being guided such that its center is widthwise shifted. This makes it difficult and seriously troublesome to adjust and stabilize the folding line at a correct position on the supply line.

At the folding step, moreover, because the center of wet tissue is liable to be offset, the center line 64 or the folding line 65 is liable to move out of position. With this discrepancy in the folding size, the overlapping area between the upper half 62 of the lower wet tissue 61C and the intermediate portion 66 of the upper wet tissues 61C fails to take one quarter of that of the unfolded wet tissue 61A accurately, so that the length of the protrusion of the wet tissue cannot be fixed. In addition, there may be such a case that the folding line 65 of the upper wet tissue and the folding line 65 of the lower wet tissue overlap each other. As a result, the central portion of the stacked body may become thick.

SUMMARY OF THE INVENTION

The invention has been conceived to solve the above-mentioned problems of the prior art and has an object to provide a wet tissue product in which when a wet tissue is pulled out, the protrusion of the succeeding wet tissue is appropriately small.

Another object of the invention is to provide a wet tissue product in which the protrusion of the wet tissue can always be constant.

The present invention provides a wet tissue product comprising: a stacked body of folded wet tissues; and a container or package housing the stacked body, wherein each of the folded wet tissues is formed by folding a plane wet tissue with opposite edges thereof to the same side along folding line portions to have a first folded portion, a second folded portion and an intermediate portion between the first and second folded portions, and the folded wet tissues are so consecutively combined that the folding line portion forming the second folded portion of the upper wet tissue is sandwiched between the first folded portion and the intermediate portion of the succeeding lower wet tissue, and the second folded portion of the upper wet tissue and the first folded portion of the lower wet tissue are in face-to-face contact with each other.

In the present invention, it is preferred that each of the folded portions has an area about one quarter as large as that of the unfolded wet tissue.

DETAILED DESCRIPTION OF THE INVENTION

The invention will be described with reference to the accompanying drawings.

Figure 1A:
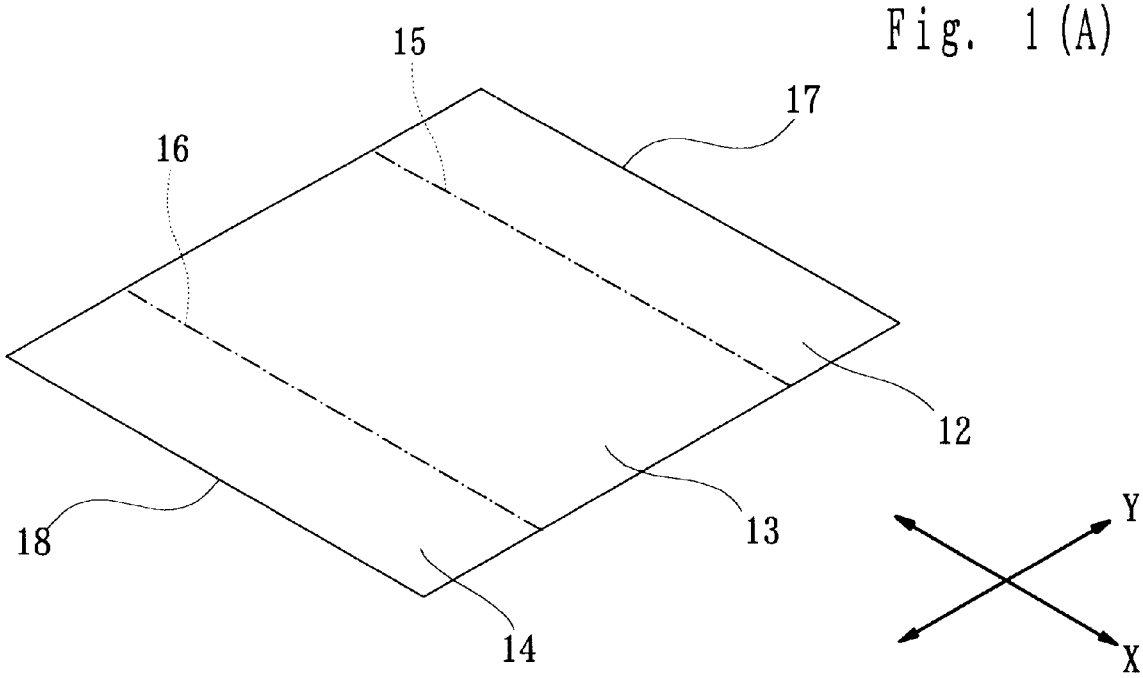
FIGS. 1(A) and 1(B) are perspective views showing a method of folding a wet tissue for an embodiment of the wet tissue product according to the invention.
Figure 1B:
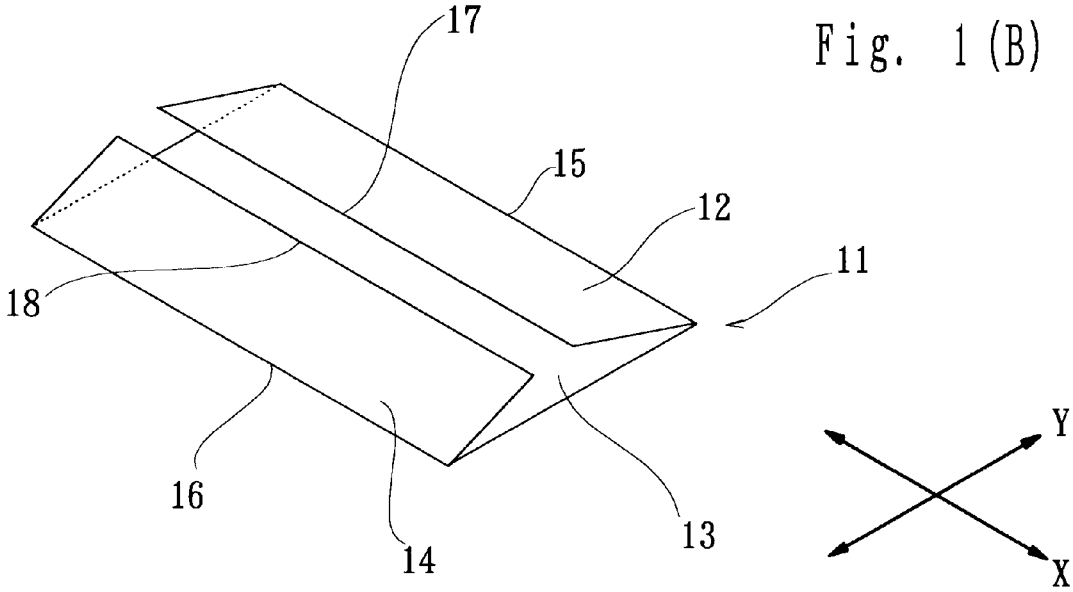
Figure 2:
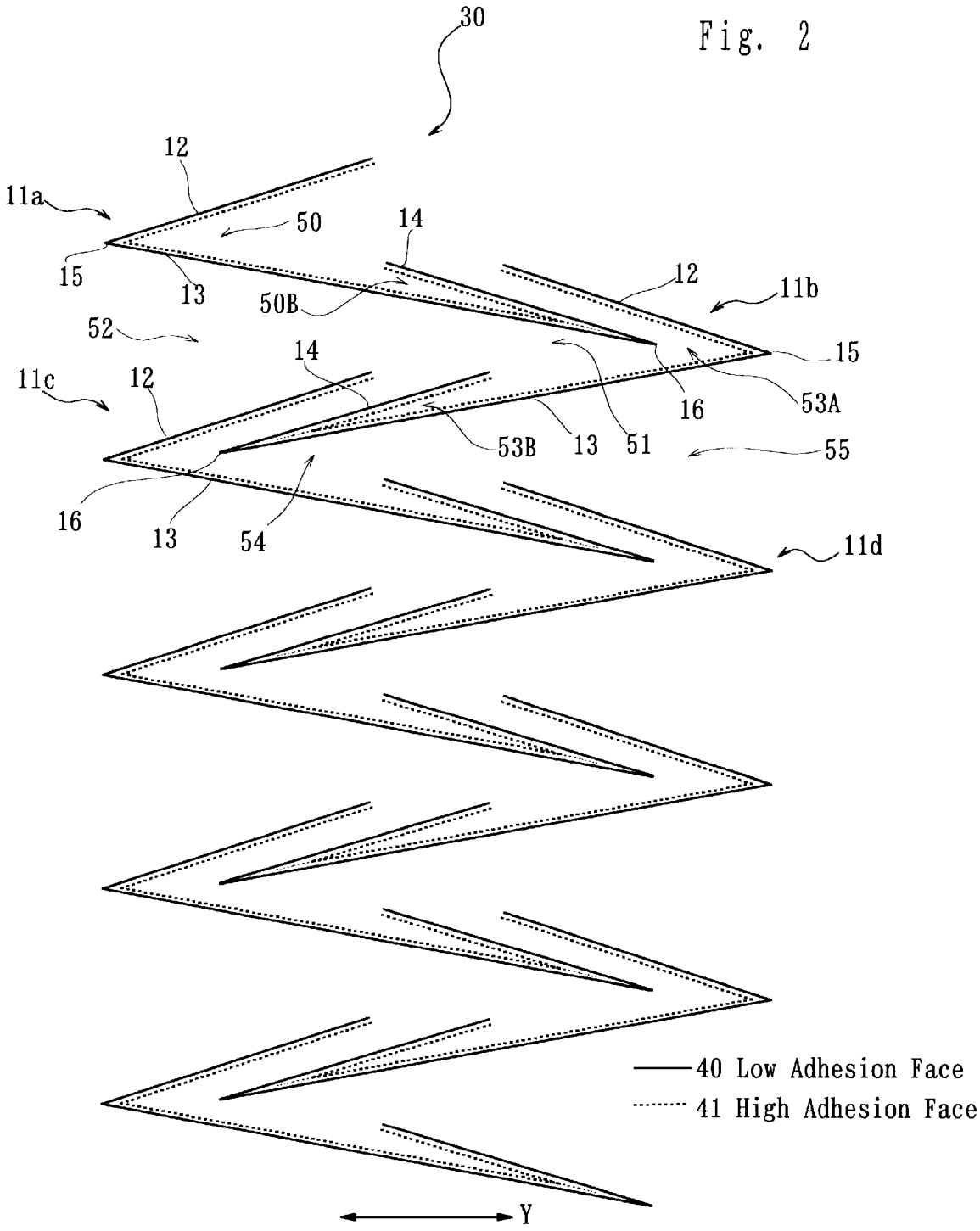
FIG. 2 is a section for explaining a method of combining the folded wet tissues shown in FIG. 1(B)
Figure 3:
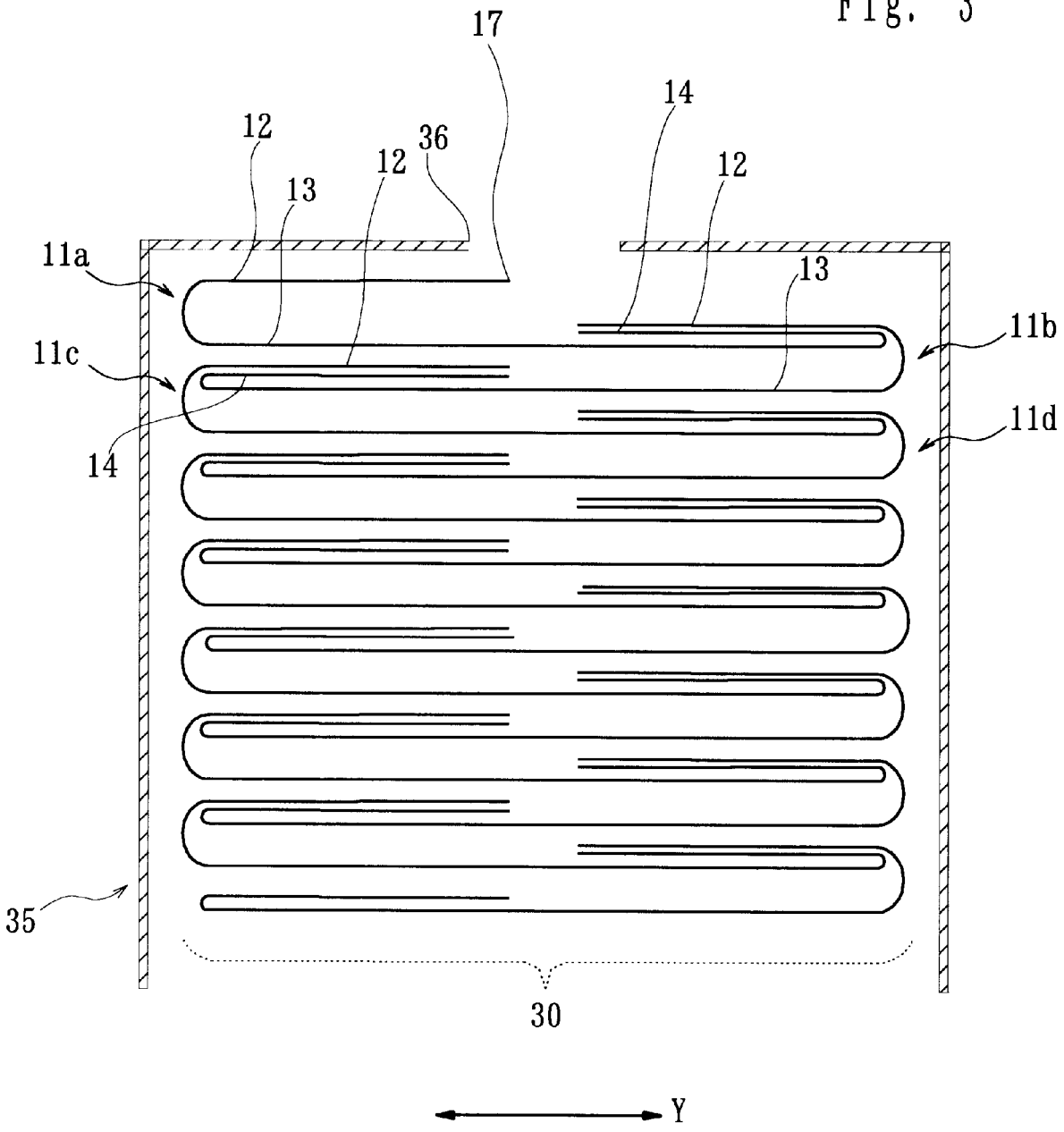
FIG. 3 is a section of an embodiment of the wet tissue product composed of the folded wet tissues shown in FIG. 1(B)

FIG. 3 is a section showing an embodiment of a wet tissue product according to the invention. FIGS. 1(A) and 1(B) are perspective views showing a method of folding a plane wet tissue to form a folded wet tissue for the wet tissue product shown in FIG. 3. FIG. 2 is a section for explaining a method of combining the folded wet tissues shown in FIG. 1(B).

Here will be described a folded wet tissue 11 for the first embodiment of the wet tissue product according to the invention. The folded wet tissue 11 is formed by folding a plane wet tissue into three portions. As shown in FIG. 1(A), the plane wet tissue before being folded has a rectangular shape (having a lateral dimension in the direction X and a longitudinal dimension in the direction Y). The folded wet tissue 11 is formed such that one laterally extending edge 17 is folded upward along a folding line portion 15 extending in parallel with the edge 17 and the other laterally extending edge 18 is folded upward along a folding line portion 16 extending in parallel with the edge 18. That is, the folded wet tissue 11 is formed by folding the edges 17 and 18 to the same side, along the folding line portions 15 and 16. The folded wet tissue 11 thus obtained has a general shape of letter "C", as shown in FIG. 1(B). This folded wet tissue 11 has a first folded portion 12, which is formed by the folding line portion 15, a second folded portion 14, which is formed by the folding line portion 16, and an intermediate portion 13 intervening between the first and second folded portions 12 and 14. Here, in this embodiment (as shown in FIGS. 1(A) and 1(B)), the folding line portions 15 and 16 extend in the direction X (i.e., in the lateral direction of the unfolded wet tissue), and the folding line portion 15 is spaced from the edge 17 by about one quarter of the longitudinal dimension of the plane wet tissue (i.e., unfolded wet tissue) whereas the folding line portion 16 is spaced from the edge 18 by about one quarter of the longitudinal dimension of the plane wet tissue (i.e., unfolded wet tissue). Therefore, the first folded portion 12 and the second folded portion 14 each have an area of about one quarter as large as that of the plane wet tissue (i.e., unfolded wet tissue).

The folded wet tissues 11 thus obtained are stacked in such a manner as shown in FIG. 2, such that a wet tissue stacked body 30 as shown in FIG. 3 is provided. Here, in order to facilitate the explanation of the stacked state, the individual folded wet tissues 11 are designated numerals 11*a*, 11*b*, 11*c* and 11*d* in an order which begins from the top of the stacked body 30.

As shown in FIG. 2, each wet tissue 11 is combined with its underlying wet tissue 11, having its folding line portion 16 forming the second folded portion 14 sandwiched between the first folded portion 12 and the intermediate portion 13 of the underlying wet tissue 11. For example, the folding line portion 16 of the wet tissue 11*a* is sandwiched between the first folded portion 12 and the intermediate portion 13 of the wet tissue 11*b*, and the folding line portion 16 of the wet tissue 11*b* is sandwiched between the first folded portion 12 and the intermediate portion 13 of the wet tissue 11*c*.

As described above, a plurality of the folded wet tissues 11 are consecutively combined to provide the wet tissue stacked body 30, as shown in FIG. 3. This stacked body 30 is constructed by combining a number of, e.g., fifty or one hundred wet tissues. Here, the wet tissue stacked body 30 is thinner than that of the prior art.

In FIG. 3, the wet tissue stacked body 30 is housed in a container 35 having an outlet 36 for pulling out the wet tissues, to provide the wet tissue product of the invention. Here, the bottom of the container 35 is omitted in FIG. 4, but the container 35 is sealed up excepting the outlet 36 so as to prevent the wet tissues from drying up. Further, the container 35 is generally provided with a cover (or lid) for closing (or covering around) the outlet 36 when the product is unused, although it is omitted in FIG. 4.

Before use, the outlet 36 confronts the edge 17 of the first folded portion 12 of the uppermost folded wet tissue 11*a*. Upon use, this uppermost folded wet tissue 11*a* is pulled out from the outlet 36 by pinching its edge 17. At this time, the first folded portion 12 of the succeeding folded wet tissue 11*b* is pulled up together with the second folded portion 14 of the wet tissue 11*a* and then comes out of the outlet 36. That is, when the folded wet tissue 11*a* is pulled out from the outlet 36, the succeeding folded wet tissue 11*b* protrudes partially from the outlet 36 and becomes the uppermost one to be pulled out next. Then, when this protruding folded wet tissue 11*b* is pulled out, the succeeding folded wet tissue 11*c* protrudes partially from the outlet 36 and becomes the uppermost one to be pulled out next, likewise.

As described above, in the wet tissue stacked body 30, when the uppermost wet tissue is pulled out, the succeeding wet tissue protrudes partially from the outlet 36. Here, the size of the protrusion of the succeeding wet tissue is determined by the overlapping area between the uppermost wet tissue and the first folded portion 12 of the succeeding wet tissue. In this embodiment, the size in the direction Y of the first folded portion 12 is about one quarter as large as the longitudinal dimension of the unfolded wet tissue, as shown in FIG. 1(A), so that the length (or height) of the protrusion from the outlet 36 is also equal to about one quarter as large as the longitudinal dimension of the unfolded wet tissue.

Thus, when the uppermost wet tissue is pulled out, the length of the protrusion of the succeeding wet tissue is so short that the wet tissue protruding partially from the outlet 36 is difficult to dry and provides a good appearance. Furthermore, in the case where the container 35 is provided with a cover for closing the outlet 36, the protrusion of the wet tissue from the outlet 36 can be easily confined within the area of the closed cover so that the outlet 36 can be easily sealed up with the cover.

Figure 9:
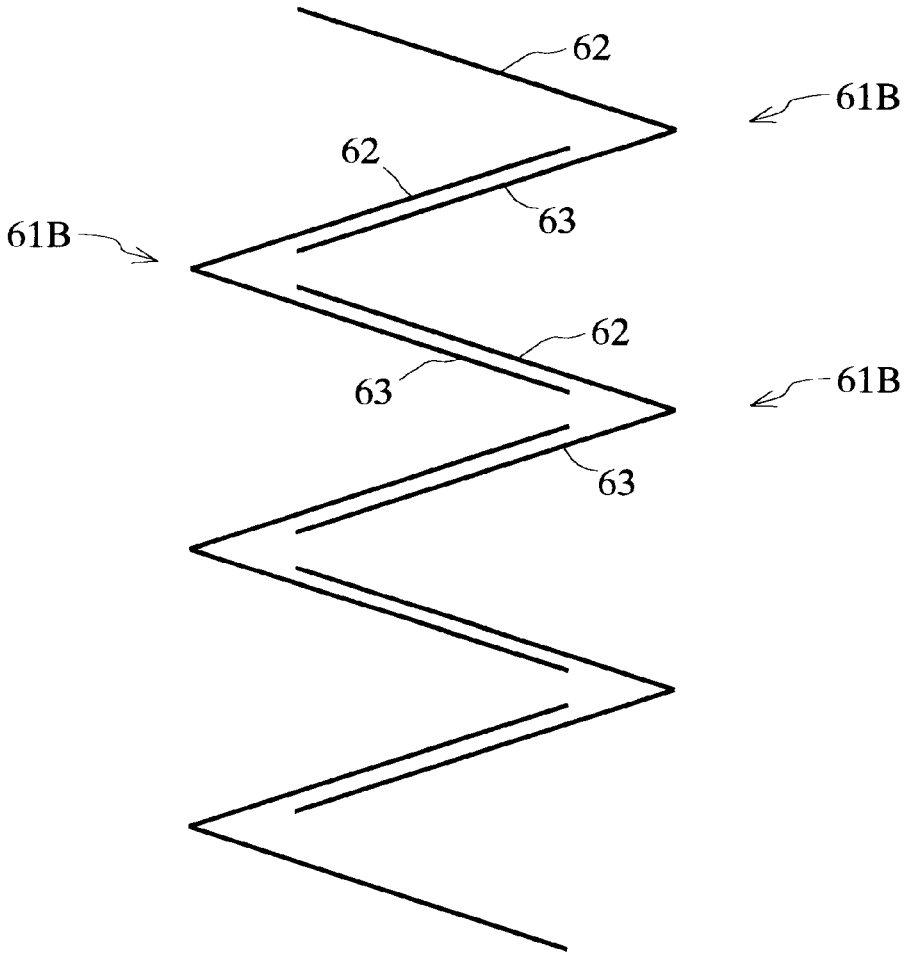
Fig. 9 PRIOR ART
FIG. 9 is a section showing a wet tissue stacked body according to the prior art.
Figure 10:
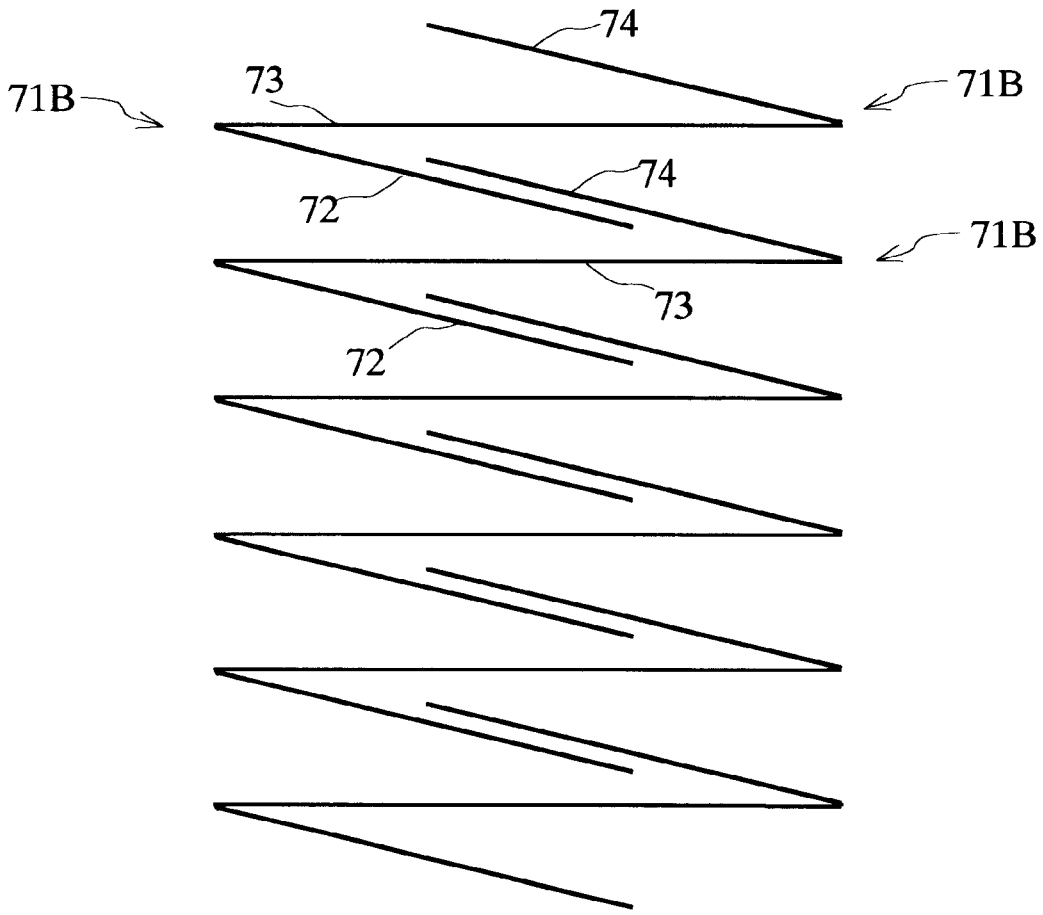
Fig. 10 PRIOR ART
FIG. 10 is a section showing a wet tissue stacked body according to the prior art.

Moreover, because the individual sizes, as taken in the direction Y, of the folded portions 12 and 14 of the wet tissue 11 are about one quarter as large as the longitudinal dimension of the unfolded wet tissue, the wet tissue stacked body 30 thus far described is kept in its total height away from extremely exceeding that of the stacked body of the prior art shown in FIG. 9, which is made by stacking the wet tissues all folded in two. Further, the thickness of the stacked body 30 can be made generally even, so that the stacked body 30 provides a good appearance.

Figure 4:
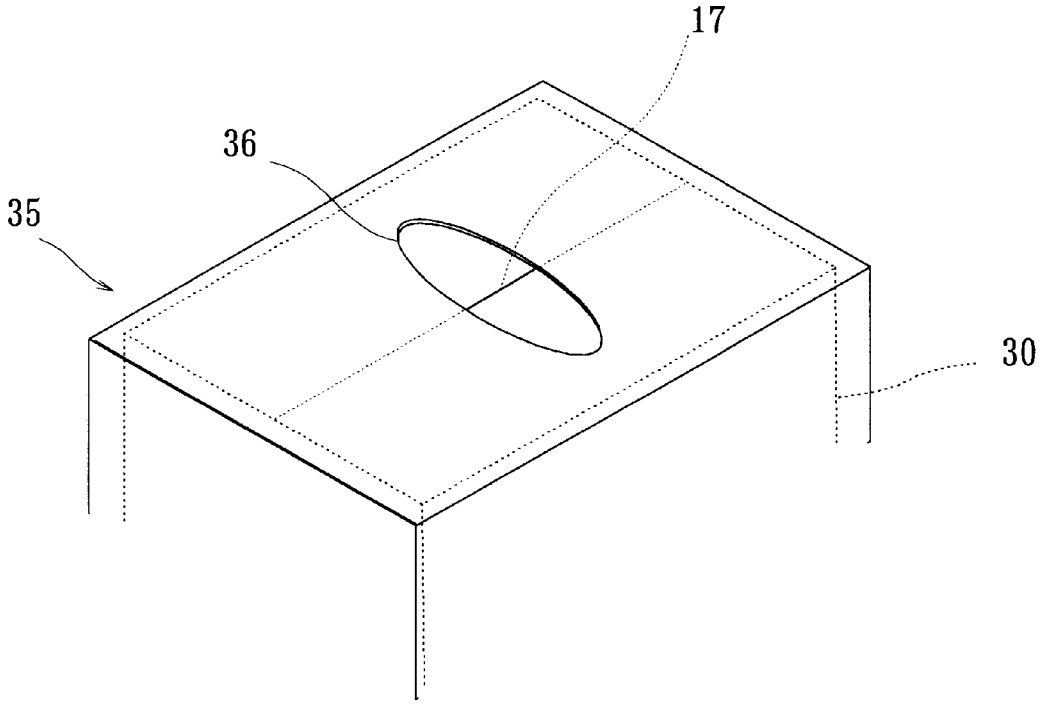
FIG. 4 is a partially perspective view of the wet tissue product shown in FIG. 3.

FIG. 4 is a partial perspective view showing the exterior of the wet tissue product of the invention, in which the stacked body 30 is housed in the container 35 as shown in FIG. 3. The outlet 36 is disposed at the substantially central portion in the upper face of the container 35. Specifically, the outlet 36 is formed at a position to confront the central portion of the faces of the folded wet tissues 11 constructing the wet tissue stacked body 30 housed in the container 35. And, the edge 17 of the uppermost wet tissue 11 appears from the outlet 36. When the user uses the wet tissue product for the first time, he or she can pull out the upper folded portion of the wet tissue 11 easily by pinching its edge 17 because the edge 17 appears in the outlet 36. The outlet 36 may be given a function as the so-called "resisting portion" to prevent the succeeding next wet tissue from being dragged and pulled out more than necessary from the outlet 36 by the upper wet tissue, when this upper wet tissue is pulled out.

In a process for producing the wet tissue stacked body 30, a long paper band (which has a width equal to the longitudinal dimension of the unfolded wet tissue shown in FIG. 1(A)) is continuously supplied so that it is folded by means of blades along the folding line portions 15 and 16 extending along the feeding direction of the paper band. These paper bands are combined in plurality in such a manner as shown in FIG. 2, and are then cut to the size of each stacked body 30 (i.e., to the lateral dimension of the unfolded wet tissue).

Figure 11:
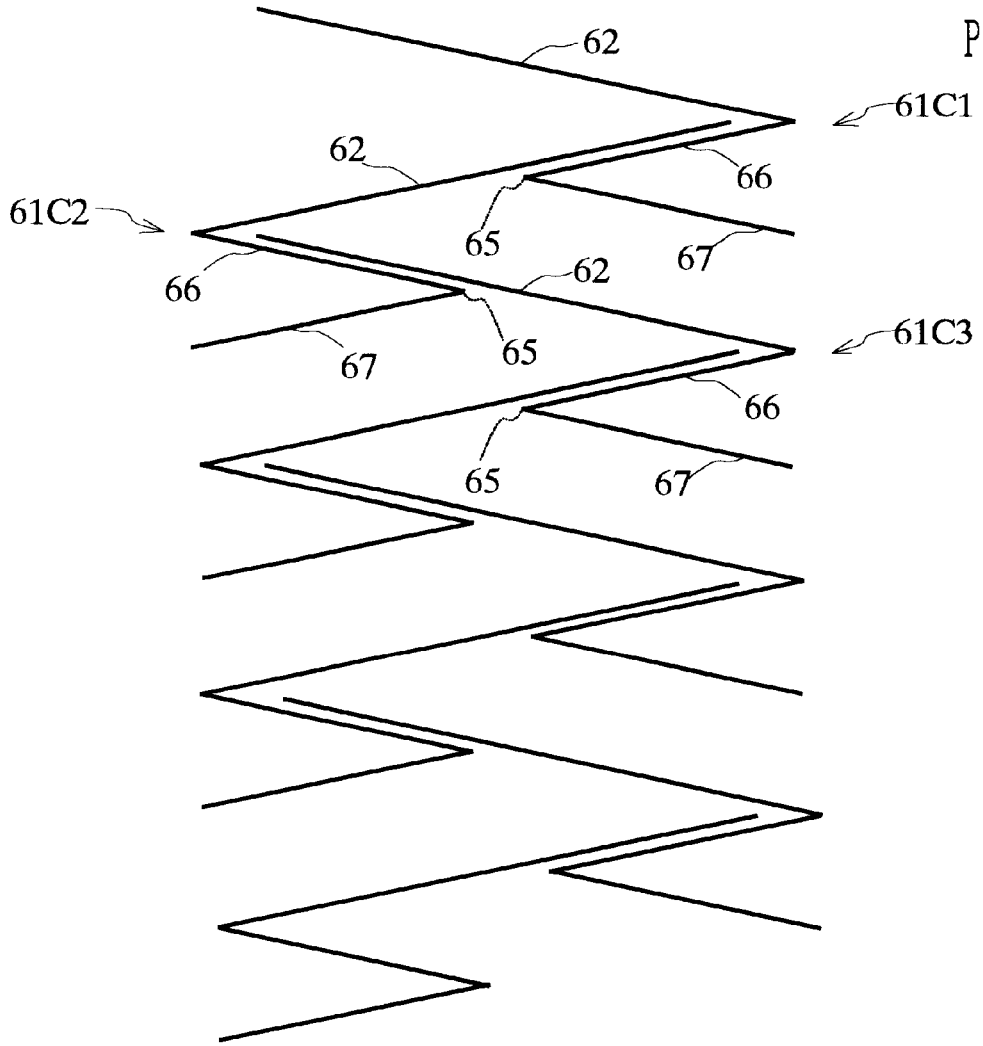
Fig. 11 PRIOR ART
FIG. 11 is a section showing a wet tissue stacked body according to the prior art.

Generally, a three-folded wet tissue is liable to have a size deviation at its folding step in the production process. Therefore, in the wet tissue stacked body of the prior art shown in FIG. 11, for example, it is difficult to stack them in a secure manner. In the wet tissues 11 composing the wet tissue stacked body 30 shown in FIG. 3, on the contrary, the center lines along the direction X are aligned between the wet tissues 11 before being folded and after being folded. Since the center lines are thus unchanged before and after the folding step, little dislocation in the direction Y occurs in the supply line of the paper band to the folding step so that the folding line portions can be accurately and easily adjusted by the blades to make the folding size accurate.

As compared with the three-folded wet tissue stacked body of the prior art, therefore, the wet tissue stacked body 30 can be produced easily and homogeneously as a whole. In other words, the overlapping areas can be set such that they are substantially uniform, between the second folded portion of the upper wet tissue and the first folded portion of the lower wet tissue. As a result, the dispersion in the length of the protrusion is reduced.

Here, the folded wet tissues 11 thus stacked are in a face-to-face contact with each other through a liquid. Subsequently, these wet tissues are adhered (or engaged) considerably strong to each other by the surface tension of the intervening liquid. The adhesion (or the engaging force), which is established when the wet tissues contact in the face-to-face relation with each other through the liquid, is influenced by the differences in the roughness of the tissue surfaces and in the hydrophilic nature and water retention of fibers appearing on the tissue surfaces.

In the case where the wet tissue is made of a spun lace nonwoven fabric, for example, it has a relatively smooth and good-sliding face (of a low adhesion (or engaging force)) on one side, which is directly treated by the water jets (or water flows for interlacing the fibers) at the step of making the spun lace nonwoven fabric, and a relatively rough and less-sliding face (of a high adhesion (or engaging force)) on the other side, which is not treated by the water jets and becomes fluffy. This result likewise applies to a wet tissue which is manufactured by the wet paper making process, and the side for confronting a cylinder mold in the paper making process becomes a relatively rough and less-sliding face (of a high adhesion (or engaging force)).

Further, there may be a wet tissue made of a nonwoven fabric having a two-layered structure composed of a layer containing more hydrophobic fibers and a layer containing more hydrophilic fibers. In this wet tissue, it is hard for the layer containing the hydrophobic fibers to retain the water so that the adhesion by the surface tension of the liquid is lowered thereby to provide a face having a relatively low adhesion (or engaging force). On the other hand, the other layer containing the hydrophilic fibers can more easily retain the water so that the adhesion by the surface tension of the liquid is enhanced thereby. As a result, a face having a relatively high adhesion (or engaging force) is provided.

When the wet tissue stacked body 30 shown in FIG. 3 is to be constructed of wet tissues each having a high adhesion face (as indicated at reference numeral 41 by broken lines in FIG. 2) and a low adhesion face (as indicated at reference numeral 40 by solid lines in FIG. 2), it is preferable that each wet tissue 11 is folded such that the intermediate portion 13 and the folded portions 12 and 14 are in face-to-face contact with their high adhesion faces 41 (as indicated by the broken line) opposed to each other. In short, it is preferable that the folded portions 12 and 14 are folded to have the high adhesion faces 41 inside.

In FIG. 2, the intermediate portion 13 and the folded portions 12 and 14 of the wet tissue 11*a* contact with each other such that their high adhesion faces 41 confront each other at mating portions 50A and 50B. Between the wet tissue 11*a* and the wet tissue 11*b*, which is positioned second from the top, moreover, the intermediate portion 13 of the wet tissue 11*a* and the intermediate portion 13 of the wet tissue 11*b* contact with each other through the low adhesion faces 40 and the high adhesion face 41 at a mating portion 51. Between the wet tissue 11*a* and the wet tissue 11*c*, which is positioned third from the top, the intermediate portion 13 of the wet tissue 11*a* and the first folded portion 12 of the wet tissue 11*c* contact with each other through the low adhesion faces 40 at a mating portion 52. This rule is to be repeated in the stacked body 30 so that the adhesions between the wet tissues at the mating portions 50A, 50B, 53A and 53B are stronger than those at the mating portions 51, 52, 54 and 55.

When the wet tissue 11*a* is pulled out, therefore, the wet tissues can be separated more easily at the mating portions 51 and 52 than at the mating portions 50A and 50B. Accordingly, the intermediate portion 13 of the wet tissue 11*a* can be easily separated from the intermediate portion 13 of the wet tissue 11*b* and the first folded portion 12 of the wet tissue 11*c*, and the second folded portion 14 of the wet tissue

11*a* can be pulled out from the outlet 36 while being in close contact with the intermediate portion 13 of the wet tissue 11*a*. As a result, only the first folded portion 12 of the wet tissue 11*b* is pulled up together with the second folded portion 14 of the wet tissue 11*a* and is protruded from the outlet 36.

With such a structure, when the uppermost wet tissue is pulled out, only the first folded portion 12 of the succeeding next wet tissue is protruded from the outlet 36. As a result, the protrusion is not excessively enlarged but is stabilized. On the other hand, because the second folded portion 14 of the uppermost wet tissue and the first folded portion 12 of the succeeding wet tissue contact with each other having the low adhesion face 40 and the high adhesion face 41 opposed to each other, the second folded portion 14 of the uppermost wet tissue and the first folded portion 12 of the succeeding wet tissue can be separated relatively easily from each other at the instant when the uppermost wet tissue is wholly pulled from the outlet 36. Therefore, the resistance to the pull-out of the wet tissue is so low that the container 35 is not pulled up by the wet tissue being pulled out.

However, if the wet tissue is made of a nonwoven fabric having no difference in adhesion (or engaging force) between the front and back sides, it is unnecessary to consider the aforementioned combination. For example, it is preferable that the wet tissue is made of a nonwoven fabric having a three-layered structure, which is composed of two outer layers containing relatively more hydrophobic fibers and an intermediate layer containing relatively more hydrophilic fibers. If this nonwoven fabric is employed, the water present between the wet tissues is reduced due to the hydrophobic fibers so that the adhesion (or engaging force) between the wet tissues due to the surface tension of the water becomes relatively weak, on both faces of each wet tissue. Therefore, when the uppermost wet tissue is pulled out, only the first folded portion 12 of the succeeding wet tissue (as overlapping the outlet side of the second folded portion 14 of the uppermost wet tissue) is pulled up and protruded. However, the remaining portions are not protruded from the outlet.

Alternatively, the wet tissue may be made of a nonwoven fabric, in which both the front and back faces are made uneven (or to have recesses). This unevenness of the wet tissue faces makes it easy for the air to enter between the confronting faces of the upper and lower wet tissues. As a result, the surface tension of water is thereby lowered such that the adhesion between the wet tissues is lowered.

Figure 5:
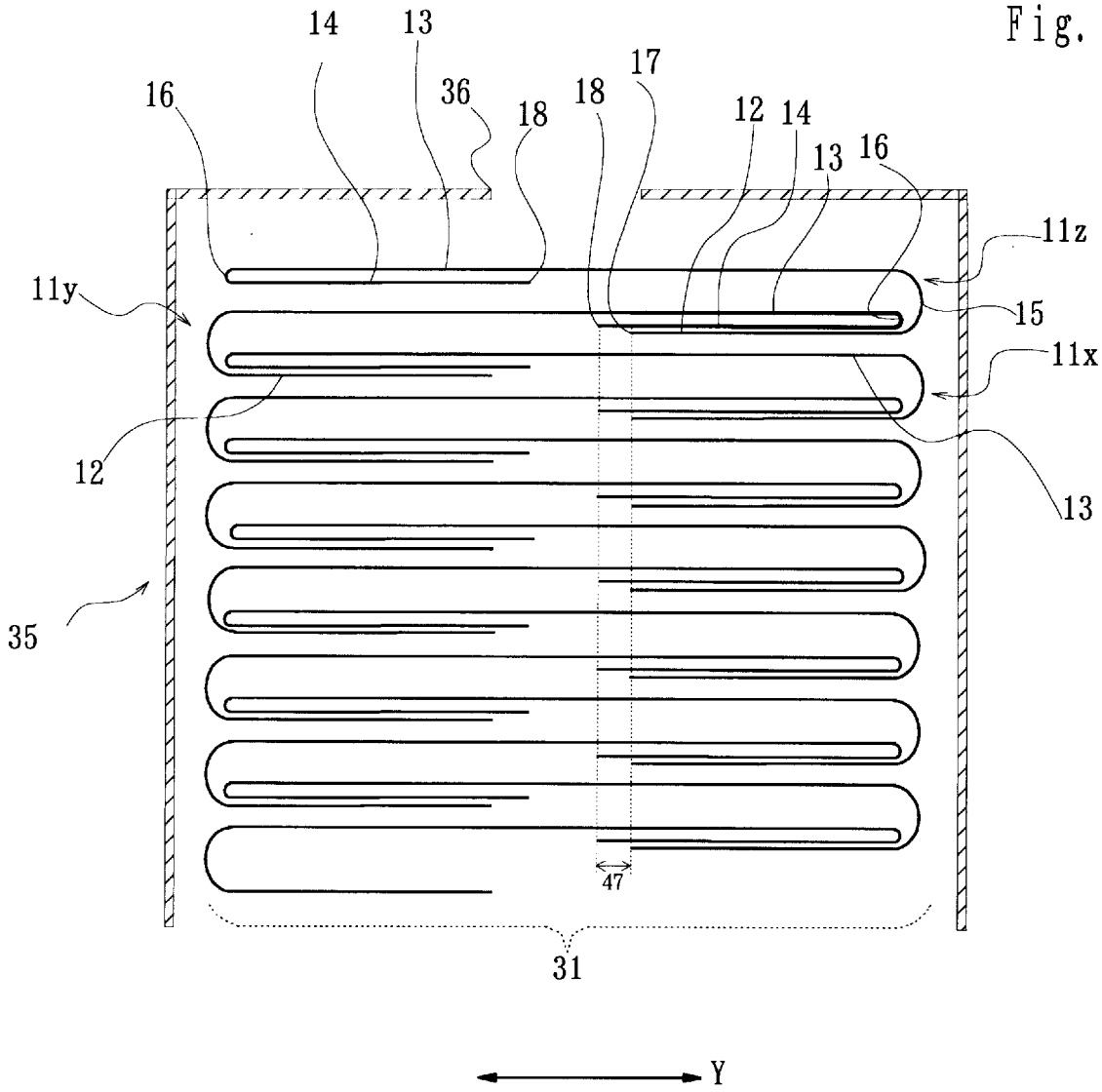
FIG. 5 is a section of another embodiment of the wet tissue product according to the invention.

FIG. 5 is a section showing another embodiment of the wet tissue product of the invention. The wet tissue product shown in FIG. 5 is obtained by housing the wet tissue stacked body 30 shown in FIG. 3 upside down in the container 35. The stacked body thus housed upside down in the container 35 is designated by reference numeral 31. In this wet tissue stacked body 31, the wet tissue at the lowermost position in the stacked body 30 confronts the outlet 36 and becomes the uppermost wet tissue designated by reference numeral 11*z*. In the stacked body 31, the individual wet tissues 11 are designated by reference numeral 11*z*, 11*y* and 11*x*, in an order which begins from the top. As shown in FIG. 5, the intermediate portion 13 of the wet tissue 11*z* confronts the outlet 36, and the folding line portion 16 of the wet tissue 11*y* is sandwiched between the first folded portion 12 and the intermediate portion 13 of the wet tissue 11*z*.

Figure 6:
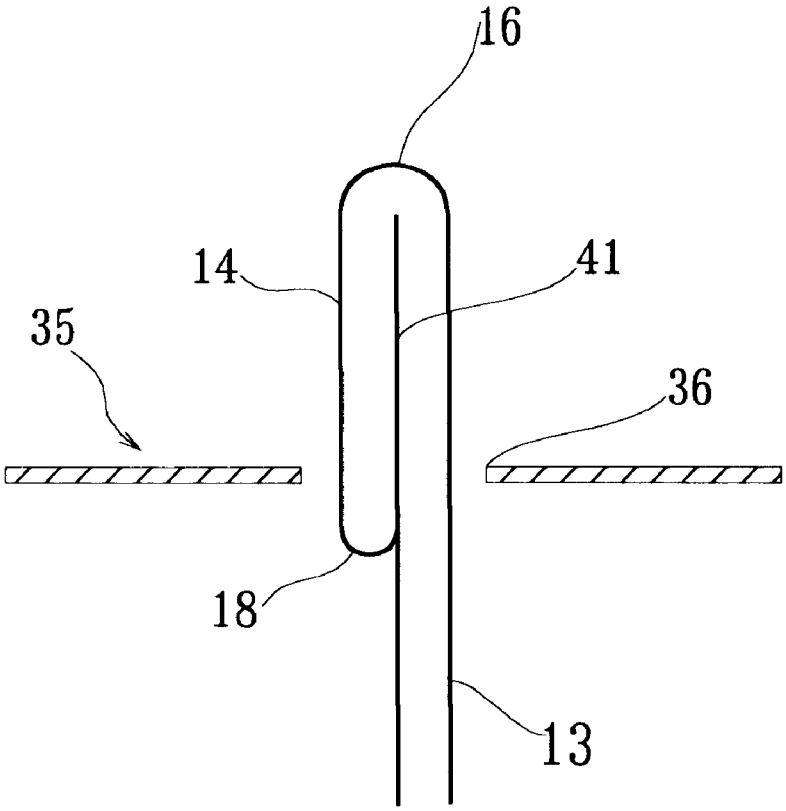
FIG. 6 is a section for illustrating a protrusion of a wet tissue.
Figure 7A:
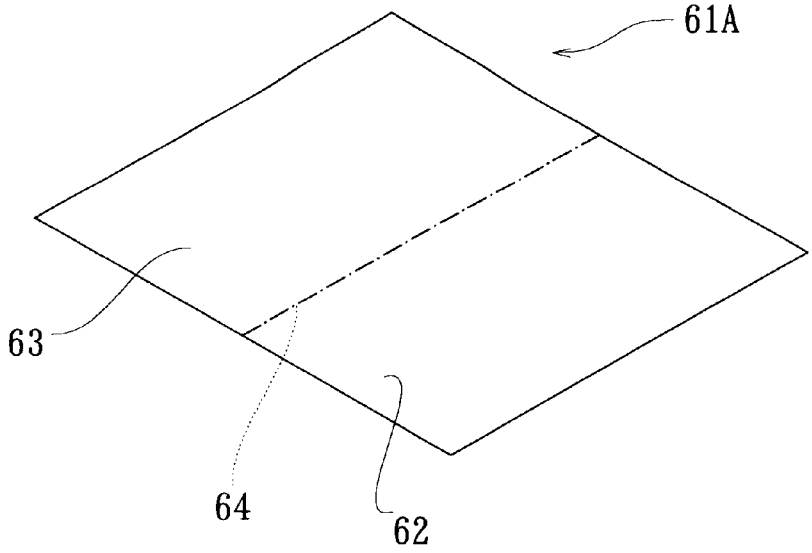
Fig. 7(A) PRIOR ART
FIGS. 7(A), 7(B) and 7(C) are perspective views showing a method by which a wet tissue is folded to form a stacked body according to the prior art.
Figure 7B:
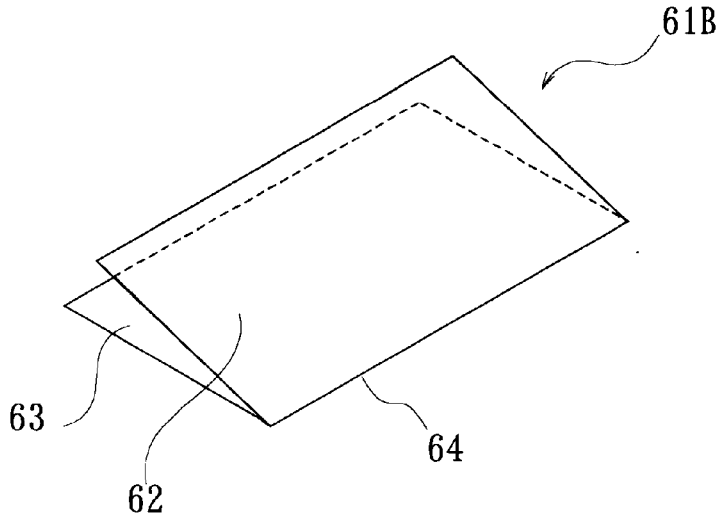
Fig. 7(B) PRIOR ART
Figure 7C:
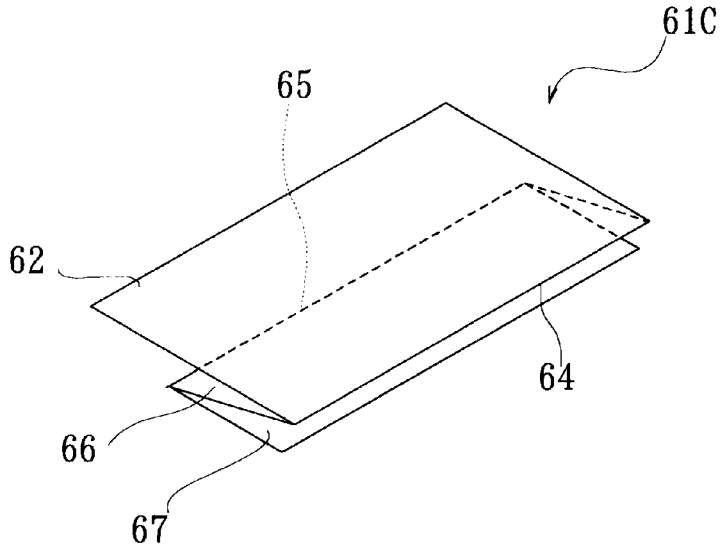
Fig. 7(C) PRIOR ART
Figure 8A:
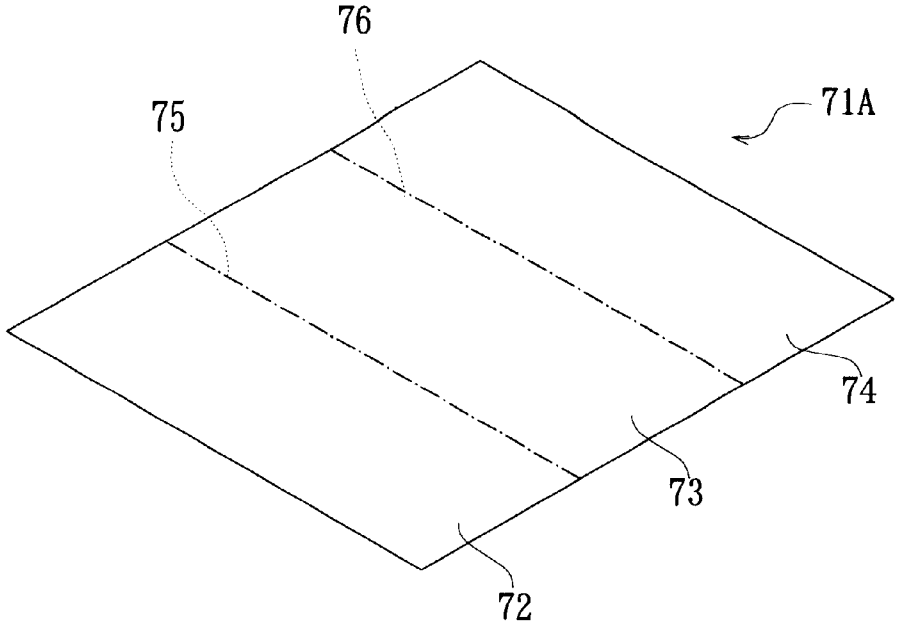
Fig. 8(A) PRIOR ART
FIGS. 8(A) and 8(B) are perspective views showing a method by which a wet tissue is folded to form a stacked body according to the prior art.
Figure 8B:
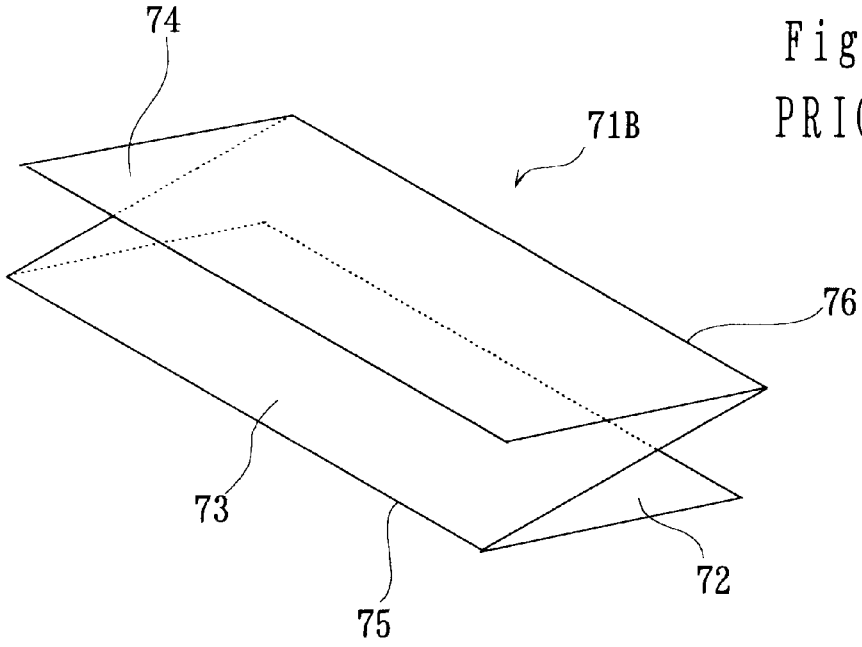
Fig. 8(B) PRIOR ART

When the uppermost wet tissue 11*z* is pulled out from the outlet 36, the second folded portion 14 and the about half of the intermediate portion 13 of the succeeding wet tissue 11*y* is pulled up together with the first folded portion 12 of the wet tissue 11*z* to be protruded from the outlet 36. At this time, as shown in FIG. 6, the wet tissue 11*y* partially protrudes such that the folding line portion 16 makes a crest while the edge 18 being left in the container 35. Then, the length of the protrusion is about or less than one quarter as long as the longitudinal dimension of the unfolded wet tissue. In this case, moreover, the second folded portion 14 and the intermediate portion 13 forming the protrusion are apt to separate from each other to form a loop. This looped protrusion provides a good appearance.

When the wet tissue stacked body 31 is composed of wet tissues each having the high and low adhesion faces 41 and 40, it is preferred that each wet tissue is folded such that the intermediate portion 13 and the folded portions 12 and 14 are in face-to-face contact with their high adhesion faces 41 opposed to each other. In short, it is preferable that the folded portions 12 and 14 are folded to have the high adhesion face 41 inside. The combination between the high adhesion face 41 and the low adhesion face 40 at this time is identical to that in the wet tissue stacked body 30 shown in FIG. 2.

In this case, the first folded portion 12 of the uppermost wet tissue 11*z* and the intermediate portion 13 of the wet tissue 11*x* positioned third from the top confront each other through the low adhesion faces 40. Accordingly, when the wet tissue 11*z* is pulled out, the wet tissue 11*z* is easily separated from the wet tissue 11*x*. Further, the second folded portion 14 and the intermediate portion 13 of the wet tissue 11*y* confront each other through the high adhesion faces 41. Therefore, when the wet tissue 11*z* is pulled out, the wet tissue 11*y* protrudes from the outlet 36 with its folded portion 14 and intermediate portion 13 being in close contact with each other. Moreover, because the intermediate portion 13 and the first folded portion 12 of the wet tissue 11*z* and the second folded portion 14 and the intermediate portion 13 of the wet tissue 11*y* contact with each other through the low and high adhesion faces 40 and 41, the wet tissue 11*z* and the wet tissue 11*y* are separated relatively easily at the instant when the wet tissue 11*z* comes out from the outlet 36.

On the other hand, the wet tissue stacked body 31 may be composed of wet tissues each having two low adhesion faces, in place of the aforementioned wet tissues each having the high and low adhesion faces.

When the wet tissue is to be protruded as shown in FIG. 6, it is preferable that the distance between the edge 18 of the lower wet tissue and the edge 17 of the upper wet tissue is adjusted so that the edge 18 of the lower wet tissue may be left without fail in the container 35. For example, it is preferable that the edge 18 of the lower wet tissue is closer to the central portion of the stacked body 31 than the edge 17 of the upper wet tissue. In the wet tissue stacked body 31, as shown in FIG. 5, the edge 17 of the uppermost wet tissue 11*z* is spaced by a distance 47 from the edge 18 of the succeeding wet tissue 11*y*. When the wet tissue 11*z* is pulled out, the second folded portion 14 and the intermediate portion 13 of the wet tissue 11*y* are protruded from the outlet 36 exclusively at the portion located on the lefthand side relative to the edge 17 of the wet tissue 11*z* in FIG. 5. In other words, the second folded portion 14 of the wet tissue 11*y* is left in the container at the portion indicated by the distance 47 from the edge 18. The distance 47 is preferably 3 mm or more, more preferably 5 mm or more.

When the wet tissue stacked body 31 shown in FIG. 5 is to be sold as a product by housing it in the container or package, only the first wet tissue confronting the outlet (e.g., uppermost wet tissue) may be folded in a shape different from the wet tissue 11 shown in FIG. 1(B), so that it may be easily pulled out when the user uses the unused product for the first time. For example, the first wet tissue is preferably folded such that the edge 18 or the folding line portion 16 confronts the outlet. After the first wet tissue was pulled out, the continuing wet tissues consecutively protrude from the outlet.

The aforementioned wet tissues 11 are made of a nonwoven fabric or paper composed of natural fibers and/or synthetic fibers. For example, use can be made of a spun lace nonwoven fabric made of polyethylene or polypropylene and having a high wet strength. The size of the unfolded wet tissue, as shown in FIG. 1(A), is exemplified by about 150×200 mm, although it can be suitably changed depending upon the size of the container or package. The wet tissues 11 are impregnated with water, alcohol, humectants, surface active agents, perfumes, antiseptics, mildewcides or the like.

The container 35 is made from a relatively hard synthetic resin such as polyethylene, polypropylene or the like. The outlet 36 is preferably provided with a cover for closing (covering around) the outlet 36 so as to seal up the container 35 and prevent the protruded wet tissue from drying up. Alternatively, instead of the hard container 35, a package (or envelope) of a liquid-impermeable film may be used to house the wet tissue stacked body. In addition, the wet tissue product of the invention can also be used as the so-called "refill package", in which the wet tissue stacked body housed in the package is further housed in a hard container.

In the wet tissue stacked body 30 and 31 thus far described, the size in the direction Y of the folded portions of the wet tissue 11 is set about one quarter as long as the longitudinal dimension of the unfolded wet tissue. However, the wet tissue stacked body may be composed of wet tissues in which the folding line portions 15 and 16 are apart from the edges 17 and 18 by about one fifth of the longitudinal dimension of the unfolded wet tissue. In this case, the length of the protrusion of the wet tissue can be made much shorter to about one fifth of the longitudinal dimension of the unfolded wet tissue.

In the wet tissue stacked body of the invention, however, there will be a more or less size dispersion at the folding step of the production process. The folding line portions 15 and 16 are not always located accurately at one quarter or one fifth of the longitudinal dimension of the unfolded wet tissue from the edges, but may be located at less than or about one quarter or one fifth of the longitudinal dimension of the unfolded wet tissue.

Moreover, in the wet tissue stacked body of the invention, the length of the protrusion can be adjusted in accord with demand by adjusting the locations of the folding line portions 15 and 16. Therefore, the folding line portions 15 and 16 may be located at one third or one sixth of the longitudinal dimension of the unfolded wet tissue from the edges, for example. However, the length of the protrusion of the wet tissue in the general use is preferably one quarter or less of the longitudinal dimension of the unfolded wet tissue. In addition, when the folding line portions 15 and 16 are located apart from the edges 17 and 18 by one quarter of the longitudinal dimension of the unfolded wet tissue, the individual folded portions of the wet tissue are divided to the right and left of the stacked body so that the thickness of the stacked body is made generally even. Therefore, the stacked body is well shaped to provide a good appearance.

While in the foregoing specification this invention has been described in relation to preferred embodiments and many details have been set forth for purpose of illustration it will be apparent to those skilled in the art that the invention is susceptible to additional embodiments and that certain of the details described herein can be varied considerably without departing from the basic principles of the invention.

Further, 'comprises/comprising' when used in this specification is taken to specify the presence of stated features, integers, steps or components but does not preclude the presence or addition of one or more other features, integers, steps, components or groups thereof.

What is claimed is:

1. A wet tissue product comprising: a stacked body of folded wet tissues; and one of a container and package for housing the stacked body, wherein each of the folded wet tissues is formed by folding a plane wet tissue with opposite edges thereof to the same side along folding line portions to have a first folded portion, a second folded portion and an intermediate portion between the first and second folded portions, and the folded wet tissues are consecutively combined such that a folding line portion forming the second folded portion of an upper wet tissue is sandwiched between the first folded portion and the intermediate portion of a succeeding lower wet tissue, and the second folded portion of the upper wet tissue and the first folded portion of the lower wet tissue are in face-to-face contact with each other.

2. The wet tissue product according to claim 1, wherein: each folded portion has an area about one quarter as large as that of an unfolded wet tissue.

3. The wet tissue product according to claim 2, wherein: each wet tissue has one face which has a low adhesion and another face which has a high adhesion, and the folded portions are folded such that the high adhesion side faces inward.

4. The wet tissue product according to claim 2, wherein: one of the container and package has an outlet, and the stacked body of wet tissues is housed in one of the container and package such that the first folded portion faces toward the outlet.

5. The wet tissue product according to claim 2, wherein: one of the container and package has an outlet, and the stacked body of wet tissues is housed in one of the container and package such that the intermediate portion faces toward the outlet.

* * * * *